US006112561A

United States Patent [19]

Carl

[11] Patent Number: 6,112,561

[45] Date of Patent: Sep. 5, 2000

[54] SECURITY DEVICE FOR A PORTABLE COMPUTER

[75] Inventor: Stewart R. Carl, Palo Alto, Calif.

[73] Assignee: ACCO Brands, Inc., Lincolnshire, Ill.

[21] Appl. No.: 08/744,890

[22] Filed: Nov. 8, 1996

Related U.S. Application Data

[63] Continuation of application No. 08/296,730, Aug. 26, 1994, abandoned.

[51] Int. Cl.[7] ..... E05B 73/00

[52] U.S. Cl. ..... 70/58; 70/14

[58] Field of Search ..... 70/14, 18, 423, 70/424, 58

[56] References Cited

U.S. PATENT DOCUMENTS

| | | | |
|---|---|---|---|
| 87,045 | 3/1869 | Dante | 70/424 |
| D. 232,416 | 8/1974 | Gazda, et al. . | |
| 505,299 | 9/1893 | Schneider . | |
| 786,842 | 4/1905 | Robeson . | |
| 881,364 | 3/1908 | Wheeler . | |
| 934,928 | 9/1909 | Michel . | |
| 942,537 | 12/1909 | Batdorf . | |
| 952,411 | 3/1910 | Billy . | |

(List continued on next page.)

FOREIGN PATENT DOCUMENTS

| | | | |
|---|---|---|---|
| 791364 | 8/1968 | Canada . | |
| 987121 | 4/1976 | Canada . | |
| 14095 | 5/1905 | European Pat. Off. | 70/424 |
| 45574 | 3/1913 | France . | |
| 455740 | 3/1913 | France | 70/424 |
| 1026519 | 10/1950 | France . | |
| 1085107 | 1/1955 | France | 70/14 |
| 2308006 | 4/1976 | France . | |
| 2636686 | 3/1990 | France . | |
| 329934 | 12/1920 | Germany . | |
| 577757 | 5/1933 | Germany . | |
| 3627334 | 7/1987 | Germany | 70/58 |
| 1256295 | 12/1971 | United Kingdom . | |
| 1376011 | 12/1974 | United Kingdom . | |
| 2109109 | 5/1983 | United Kingdom . | |

OTHER PUBLICATIONS

Kablit Security System Catalog, pp. 7, 93, 1988. *Computer and Office Equipment Security Catalog*, ©1990 by Secure–It, Inc., 18 Maple Court, East Long–meadow, Mass. 01028.

Kensington Product Brochure for Kensington Apple®, LaserWriter® and Macintosh® Portable Security Systems. *Computer and Office Equipment Security Catalog*, ©1990 by Secure–It, Inc. 18 Maple Court, East Longmeadow, MA 01028.

Apple Security Bracket Sold in AS Kit.

Retaining Device Incorporated in Apple Computers.

*Primary Examiner*—B. Dayoan

*Assistant Examiner*—Gary Estremsky

*Attorney, Agent, or Firm*—Townsend and Townsend and Crew LLP

[57] ABSTRACT

An apparatus which inhibits the theft of equipment such as personal computers is disclosed. In a preferred embodiment, a locking interface for the specially designed slot includes two legs pivotably coupled together about an articulation point. The two legs each have opposing flanges on a first end and handles on a second end. The two legs define a first and a second position, with the flanges and legs adapted for insertion and removal when in the first position. The flanges engage an inner surface of the wall when the legs are in the second position. The preferred embodiment includes a retainer that is coupled to the handles of the first and second legs that retain the legs in the second position when the flanges engage the inner surface. In the preferred embodiment, the handles define an aperture and an object extends through the aperture to hold the legs in the second position. The object may be any suitable object, including a cable or shackle of a lock.

16 Claims, 2 Drawing Sheets

U.S. PATENT DOCUMENTS

| | | | |
|---|---|---|---|
| 1,452,471 | 4/1923 | Kline . | |
| 1,470,937 | 10/1923 | Schou . | |
| 1,534,936 | 4/1925 | Fischbach . | |
| 1,672,333 | 6/1928 | Miller . | |
| 1,786,511 | 12/1930 | Warren . | |
| 2,001,354 | 5/1935 | Smith | 70/424 |
| 2,130,216 | 9/1938 | Zaninovich . | |
| 2,190,661 | 2/1940 | Hauer . | |
| 2,383,397 | 8/1945 | Lofqwist . | |
| 2,469,874 | 5/1949 | Fetsko, Jr. . | |
| 2,480,662 | 8/1949 | McKinzie . | |
| 2,594,012 | 4/1952 | Griffin . | |
| 2,660,084 | 11/1953 | Newman . | |
| 2,677,261 | 5/1954 | Jacobi . | |
| 2,729,418 | 1/1956 | Maynard . | |
| 2,800,090 | 7/1957 | Reid . | |
| 2,963,310 | 12/1960 | Abolins . | |
| 3,091,011 | 5/1963 | Campbell . | |
| 3,101,695 | 8/1963 | Honeyman, Jr. . | |
| 3,130,571 | 4/1964 | Neumann . | |
| 3,136,017 | 6/1964 | Preziosi . | |
| 3,171,182 | 3/1965 | Danehy . | |
| 3,200,694 | 8/1965 | Rapata . | |
| 3,220,077 | 11/1965 | Newcomer, Jr. et al. . | |
| 3,276,835 | 10/1966 | Hall . | |
| 3,469,874 | 9/1969 | Mercurio . | |
| 3,521,845 | 7/1970 | Sweda et al. . | |
| 3,590,608 | 7/1971 | Smyth et al. . | |
| 3,634,963 | 1/1972 | Hermann . | |
| 3,664,163 | 5/1972 | Foote . | |
| 3,722,239 | 3/1973 | Mestre . | |
| 3,727,934 | 4/1973 | Averbook et al. . | |
| 3,737,135 | 6/1973 | Bertolini . | |
| 3,754,420 | 8/1973 | Oellerich . | |
| 3,765,197 | 10/1973 | Foote . | |
| 3,771,338 | 11/1973 | Raskin . | |
| 3,772,645 | 11/1973 | Odenz et al. . | |
| 3,782,146 | 1/1974 | Franke . | |
| 3,785,183 | 1/1974 | Sander . | |
| 3,798,934 | 3/1974 | Wright et al. . | |
| 3,826,510 | 7/1974 | Halter . | |
| 3,859,826 | 1/1975 | Singer et al. . | |
| 3,866,873 | 2/1975 | Bohli . | |
| 3,875,645 | 4/1975 | Tucker et al. . | |
| 3,910,079 | 10/1975 | Gassaway . | |
| 3,910,081 | 10/1975 | Pender . | |
| 3,986,780 | 10/1976 | Nivet . | |
| 3,990,276 | 11/1976 | Shontz . | |
| 3,999,410 | 12/1976 | Hall . | |
| 4,003,228 | 1/1977 | Lievens et al. . | |
| 4,004,440 | 1/1977 | Dreyer . | |
| 4,007,613 | 2/1977 | Gassaway . | |
| 4,018,339 | 4/1977 | Pritz . | |
| 4,028,913 | 6/1977 | Falk . | |
| 4,028,916 | 6/1977 | Pender . | |
| 4,047,748 | 9/1977 | Whaley et al. . | |
| 4,055,973 | 11/1977 | Best . | |
| 4,057,984 | 11/1977 | Avaiusini . | |
| 4,065,083 | 12/1977 | Gassaway . | |
| 4,066,195 | 1/1978 | Dickler . | |
| 4,114,409 | 9/1978 | Scire . | |
| 4,118,902 | 10/1978 | Saxton . | |
| 4,123,922 | 11/1978 | Kuenstler . | |
| 4,131,001 | 12/1978 | Gotto . | |
| 4,212,175 | 7/1980 | Zakow . | |
| 4,223,542 | 9/1980 | Basseches . | |
| 4,252,007 | 2/1981 | Kerley . | |
| 4,300,371 | 11/1981 | Herwick et al. . | |
| 4,311,883 | 1/1982 | Kidney . | |
| 4,394,101 | 7/1983 | Richer . | |
| 4,418,550 | 12/1983 | Hamilton . | |
| 4,419,034 | 12/1983 | DiMartino . | |
| 4,442,571 | 4/1984 | Davis et al. . | |
| 4,448,049 | 5/1984 | Murray . | |
| 4,462,233 | 7/1984 | Horetzke . | |
| 4,527,405 | 7/1985 | Renick . | |
| 4,570,465 | 2/1986 | Bennett . | |
| 4,584,856 | 4/1986 | Petersdorff . | |
| 4,603,829 | 8/1986 | Koike et al. . | |
| 4,616,490 | 10/1986 | Robbins . | |
| 4,640,106 | 2/1987 | Derman . | |
| 4,655,057 | 4/1987 | Derman . | |
| 4,667,491 | 5/1987 | Lokken et al. . | |
| 4,676,080 | 6/1987 | Schwarz . | |
| 4,680,949 | 7/1987 | Stewart | 70/58 |
| 4,685,312 | 8/1987 | Lakoski . | |
| 4,691,891 | 9/1987 | Dionne . | |
| 4,704,881 | 11/1987 | Sloop, Sr. . | |
| 4,733,840 | 3/1988 | D'Amore . | |
| 4,738,428 | 4/1988 | Themistos et al. . | |
| 4,741,185 | 5/1988 | Weinert et al. . | |
| 4,805,426 | 2/1989 | Dimmick et al. . | |
| 4,826,193 | 5/1989 | Davis . | |
| 4,842,912 | 6/1989 | Hutter, III . | |
| 4,843,848 | 7/1989 | Igelmund . | |
| 4,856,304 | 8/1989 | Derman . | |
| 4,856,305 | 8/1989 | Adams . | |
| 4,858,455 | 8/1989 | Kuo . | |
| 4,870,840 | 10/1989 | Klein . | |
| 4,893,488 | 1/1990 | Klein . | |
| 4,907,111 | 3/1990 | Derman . | |
| 4,907,716 | 3/1990 | Wankel et al. . | |
| 4,918,952 | 4/1990 | Lakoski . | |
| 4,938,040 | 7/1990 | Humphreys, Jr. . | |
| 4,959,635 | 9/1990 | Wilson . | |
| 4,959,979 | 10/1990 | Filipow . | |
| 4,979,382 | 12/1990 | Perry . | |
| 4,985,695 | 1/1991 | Wilkinson et al. . | |
| 4,993,244 | 2/1991 | Osman . | |
| 5,024,072 | 6/1991 | Lee . | |
| 5,050,836 | 9/1991 | Makous . | |
| 5,063,763 | 11/1991 | Johnson . | |
| 5,076,079 | 12/1991 | Monoson et al. . | |
| 5,082,232 | 1/1992 | Wilson . | |
| 5,082,233 | 1/1992 | Ayers et al. . | |
| 5,119,649 | 6/1992 | Spence . | |
| 5,184,798 | 2/1993 | Wilson . | |
| 5,197,706 | 3/1993 | Braithwaite et al. . | |
| 5,228,319 | 7/1993 | Holley et al. . | |
| 5,279,136 | 1/1994 | Perry . | |
| 5,327,752 | 7/1994 | Myers et al. . | |
| 5,349,834 | 9/1994 | Davidge . | |
| 5,351,507 | 10/1994 | Derman . | |
| 5,351,508 | 10/1994 | Kelley . | |
| 5,361,610 | 11/1994 | Sanders . | |
| 5,370,488 | 12/1994 | Sykes . | |
| 5,381,685 | 1/1995 | Carl et al. . | |
| 5,390,514 | 2/1995 | Harmon . | |
| 5,398,530 | 3/1995 | Derman . | |
| 5,400,622 | 3/1995 | Harmon | 70/58 |
| 5,406,809 | 4/1995 | Igelmund . | |
| 5,412,959 | 5/1995 | Bentley . | |
| 5,421,667 | 6/1995 | Leyden et al. . | |
| 5,489,173 | 2/1996 | Höfle . | |
| 5,520,031 | 5/1996 | Davidge . | |
| 5,579,657 | 12/1996 | Makous . | |
| 5,603,416 | 2/1997 | Richardson et al. . | |
| 5,608,605 | 3/1997 | Siow et al. . | |
| 6,000,252 | 12/1999 | Murray | 70/58 |

SECURITY DEVICE FOR A PORTABLE COMPUTER

This is a Continuation of application Ser. No. 08/296,730 filed Aug. 26, 1994, now abandoned, the disclosure of which is incorporated by reference.

BACKGROUND OF THE INVENTION

The present invention relates generally to devices for inhibiting the theft of relatively small but expensive pieces of equipment. More specifically, the invention relates to a lock interface for a specially designed slot having predetermined dimensions.

Computers have evolved rather rapidly from large, expensive machines usable only by a few, to relatively small, portable machines which are usable by many. In particular, the development of desktop computers with significant processing power has made computers available to the general population. It is now common for college and even high school students to have their own computer, and desktop computers are in wide spread use as word processors and work stations in almost all forms of business. Desktop computers are relatively small and easily transportable, and an undesirable side effect of their proliferation is the fact that the theft of such computers is a significant problem.

A variety of devices have been developed to inhibit the theft of desktop computers and similar equipment. Since desktop computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

Kensington Microware Limited, assignee of this application, currently provides a security system which is especially designed for use with particular Apple computers. Certain Apple computer components have slots and internal brackets designed to capture a specially designed tab inserted through the slot so that the tab is not removable. While this system is effective for particular types of Apple computers, it does not work for those Apple computer components and other computer brands which do not have the special designed slots and brackets.

It is undesirable to require a computer to have specially designed slots and internal capture brackets because the brackets occupy a significant amount of space in an item of equipment which is intended to be as space efficient as possible. Different items of Apple equipment require different sized slots, meaning that the security mechanism must provide a variety of different sized tabs. The tabs, once inserted, cannot be removed without damage to the equipment, meaning that the security system cannot be moved from one computer to the other. Even Apple computers with specially designed slots are typically used with peripheral equipment which does not have them, and, the Kensington system provides screws requiring a special screwdriver which replace the screws used to attach the existing communication cables, securing the peripheral equipment to the base computer by preventing unauthorized removal of the communication cables. This last aspect of the system has a drawback in that the peripheral equipment cannot be removed from the base computer without the special screwdriver, which can be lost or misplaced.

Other vendors provide security systems which are not required to interface directly with special slots and capture mechanisms as provided in certain Apple computers. For example, Secure-It, Inc., under the trademark "KĂBLIT", provides a variety of brackets attached to the computer component using existing mounting screws, i.e., screws which are already used to secure items of equipment within the cabinet. Typically, the bracket is apertured so that passage of the cable through the aperture prevents access to the mounting screw and thus prevents removal of the bracket from the equipment. A deficiency of this type of system is that it requires the removal of the existing mounting screw, which may cause some damage to the internal components of the computer. Suitable existing screws are not always available on certain peripherals for convenient attachment of the fastener. For this latter reason, KĂBLIT also provides glue-on disks which, unfortunately, are permanently secured to the equipment.

The theft of small but expensive equipment such as desktop or laptop computers is a growing problem. Existing devices are simply too inefficient or ineffective, or their application is too limited. As a result, the use of such security systems is rare, computer equipment is typically left unprotected, and it is all too often stolen.

SUMMARY OF THE INVENTION

The present invention provides a simple yet efficient solution to the prior art problem of inhibiting theft of portable equipment. Specifically, the present invention discloses lock interfaces for a specially designed slot having predetermined dimensions and methods of providing a locking interface to a specially designed slot.

In a preferred embodiment, a locking interface for the specially designed slot includes two legs pivotably coupled together about an articulation point. The two legs each have opposing flanges on a first end and handles on a second end. The two legs define a first and a second position, with the flanges and legs adapted for insertion and removal when in the first position. The flanges engage an inner surface of the wall when the legs are in the second position. The preferred embodiment includes a retainer that is coupled to the handles of the first and second legs that retain the legs in the second position when the flanges engage the inner surface.

In the preferred embodiment, the handles define an aperture and an object extends through the aperture to hold the legs in the second position. The object may be any suitable object, including a cable or shackle of a lock.

In operation, a user operates the first and second legs into the first position, inserts the legs into the slot, operates the handles to move the legs to the second position so that the flanges engage the slot. Thereafter, a retainer is coupled to the handles so as to hold the legs in the second position. The retainer may be a cable extending through an aperture defined by the handles of the legs, though other similar objects may be used.

Further understanding of the nature and advantages of the invention may be realized by reference to the remaining portions of the Specification and Drawings. In the drawings, similarly numbered items represent the same or functionally equivalent structures.

DETAILED DESCRIPTION OF SPECIFIC EMBODIMENTS

Figure 1:
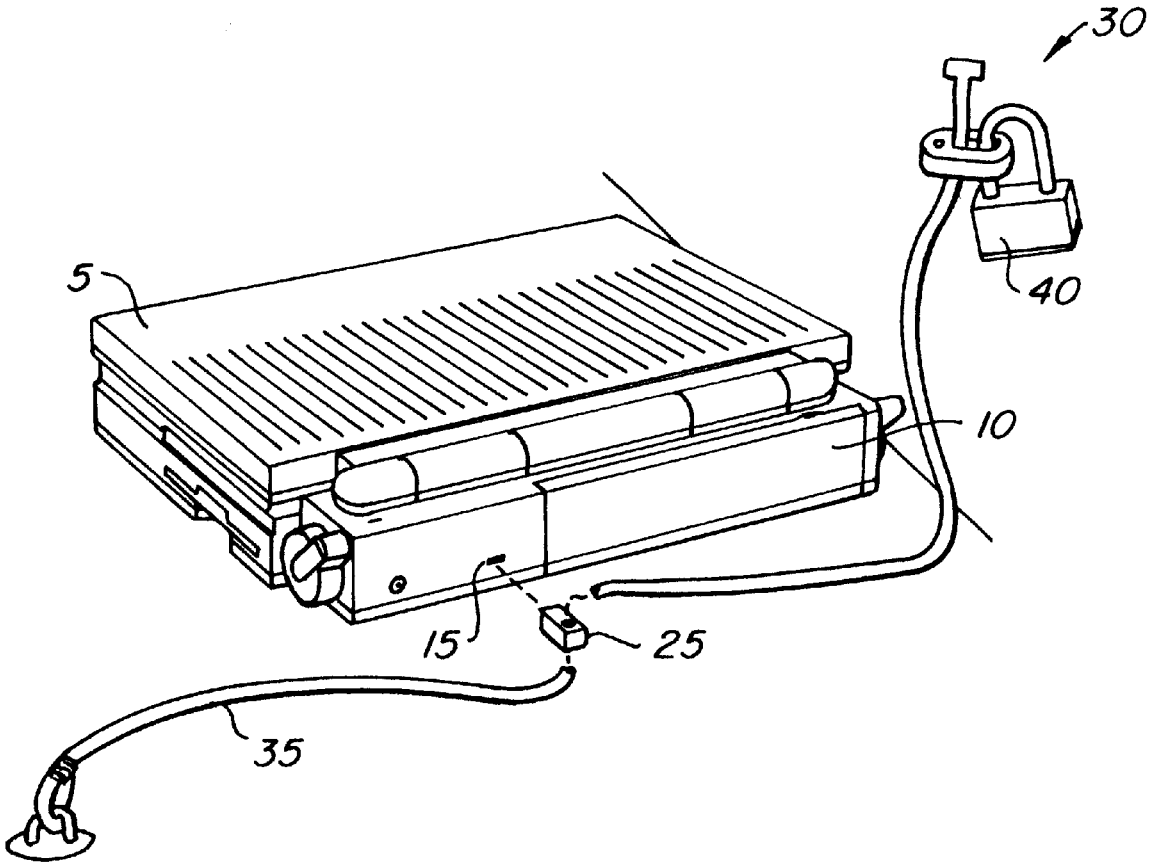
FIG. 1 illustrates a typical use of an embodiment of the present invention.

FIG. 1 illustrates a typical use of an embodiment of the present invention. A portable computer 5 has a wall 10 provided with a slot 15. Wall 10 includes an inner surface 20. A lock interface 25 is engageable with wall 10 through slot 15. A locking mechanism 30, according to the preferred embodiment, includes a cable 35 and a lock 40. In operation, a user inserts lock interface 25 into slot 15 and engages lock interface 25 with inner surface 20. Once engaged, a user can attach lock interface 25 to a stationary object with cable 35 and lock 40.

Figure 2:
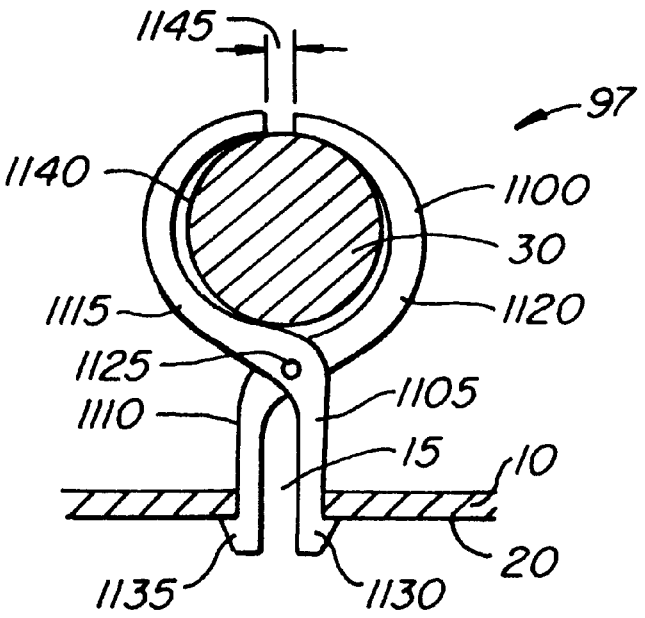
FIG. 2 illustrates another embodiment of lock interface.

FIG. 2 is a preferred embodiment of lock interface 97. Lock interface 97 includes an engagement member 1100. Engagement member 1100 includes a first leg 1105, a second leg 1110, a first handle 1115, a second handle 1120, and an articulation point 1125. First leg 1105 includes a flange 1130 at a distal end that is flanged away from second leg 1110, and second leg 1110 includes a flange 1135 at a distal end that is flanged away from first leg 1105. First handle 1115 and second handle 1120 are curved towards each other to define an aperture 1140 and are separated by a space 1145.

Figure 3:
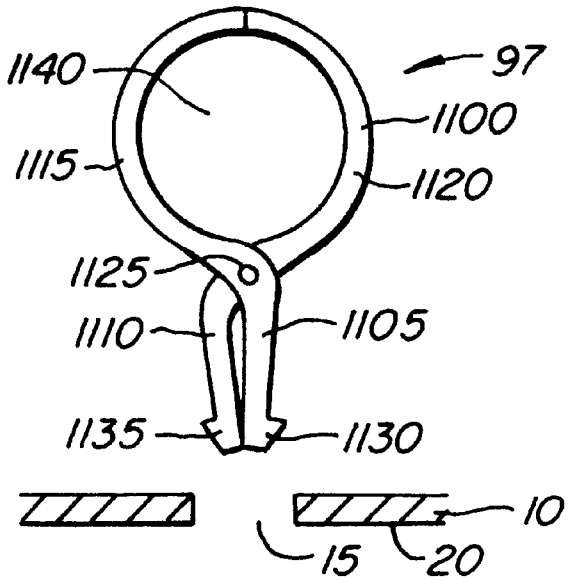
FIG. 3 is another view of the lock interface in FIG. 2 with the first leg and the second leg in the first position.

First leg 1105 and second leg 1110 are coupled to each other at articulation point 1125. When first leg 1105 and second leg 1110 move towards each other, defining a first position, first handle 1115 and second handle 1120 are moved towards each other by the distance of space 1145, and when first handle 1115 and second handle 1120 are moved away from each other, first leg 1105 and second leg 1110 move away from each other, defining a second position. FIG. 3 is another view of the lock interface in FIG. 2 with first leg 1105 and second leg 1110 in the first position. When first leg 1105 and second leg 1110 are in the first position, flange 1130 and flange 1135 are insertable and removable from slot 15. FIG. 2 illustrates that when first leg 1105 and second leg 1110 are in the second position, flange 1130 and flange 1135 are engageable with inner surface 20.

In operation, a user moves first handle 1115 and second handle 1120 towards each other, causing first leg 1105 and second leg 1110 to move into the first position, and inserts flange 1130 and flange 1135 into slot 15. Moving first handle 1115 and second handle 1120 away from each other causes first leg 1105 and second leg 1110 to move into the second position, allowing engagement of flange 1130 and flange 1135 with inner surface 20. Inserting a locking mechanism 30 through aperture 1140 maintains positioning of first handle 1115 and second handle 1120, maintains positioning of first leg 1105 and second leg 1110 in the second position, and can be used to lock the computer 5 to a stationary object.

In the foregoing specification, the invention has been described with reference to a specific exemplary embodiments thereof. It will, however, be evident that various modifications and changes may be made thereunto without departing from the broader spirit and scope of the invention as set forth in the claims.

Many changes or modifications are readily envisioned, for example, changing the shape of the slot and the shape of the head portion, adding catches to the engagement members, and changing the shape of the flanges among other changes. Additionally, where a cable is shown, some other type of rigid, non-compressible object can be used to maintain the flange in the locked position. The specification and drawings are, accordingly, to be regarded in an illustrative rather than in a restrictive sense.

What is claimed is:

1. A method of providing a locking interface to a security slot having preselected dimensions in a wall of a portable device, the wall having an inner surface, the method comprising the steps of:

placing a first and a second leg, pivotally coupled to rotate within a plane of rotation about an articulation point defined by a pin, each of said legs having opposing flanges extending within said plane of rotation on a first end and opposing handles on a second end, in a first position, said opposing flanges of said first leg and said second leg adapted for concurrent insertion and removal from the slot when in said first position, said opposing flanges of said first leg and said second leg adapted for engagement with the inner surface in a second position;

inserting said opposing flanges of said first leg and said second leg in the security slot when in said first position;

placing said first leg and said second leg in said second position;

retaining said opposing handles of said first leg and said second leg in said second position with a retainer; and coupling said retainer to an object other than to the portable device to inhibit theft of the portable device.

2. A method of providing a locking interface to a specially designed slot having preselected dimensions in a wall of a portable device, the wall having an inner surface, the method comprising the steps of:

placing a first and a second leg, pivotally coupled about an articulation point, each of said legs having opposing flanges on a first end and opposing handles on a second end, in a first position, said opposing flanges of said first leg and said second leg adapted for concurrent insertion and removal from the slot when in said first position, said opposing flanges of said first leg and said second leg adapted for engagement with the inner surface in a second position;

inserting said opposing flanges of said first leg and said second leg in the slot when in said first position;

placing said first leg and said second leg in said second position;

retaining said opposing handles of said first leg and said second leg in said second position; and coupling said legs to an object other than to the portable device to inhibit theft of the portable device.

3. An apparatus for inhibiting theft, comprising:

a portable electronic device having a wall defining a security slot, said security slot having a predetermined shape and said shape further having at least one section wherein the section's length is greater than its width, and said wall including an inner surface;

a cable; and a locking apparatus, comprising:

a first leg and a second leg, pivotally coupled to rotate within a plane of rotation about an articulation point defined by a pin, said legs each having a flange at a first end, with said flange of said first leg oppositely directed in relation to said flange of said second leg and extending within the plane of rotation, said legs each having a second end with said articulation point intermediate said first end and said second end, said legs together defining an unlocked position and a locked position wherein said first ends of said legs are adapted to be inserted into the security slot and removed from the security slot when in said unlocked position, and retained in the security slot when in said locked position, said second ends defining a closed aperture when in said unlocked position, and said second ends widening apart by a predetermined space to define an open aperture in said locked position, such that the cable passing through said open aperture when said legs are in said locked position inhibits articulation of said legs to said unlocked position; and wherein coupling of the cable to said object and to a second object other than to said first object inhibits theft of the portable device.

4. The apparatus of claim 3 wherein said aperture is formed by said second ends having an arcuate shape.

5. The apparatus of claim 3 wherein said security slot is approximately 7 mm in length and approximately 3 mm in width.

6. The apparatus of claim 3 wherein the portable device is a portable laptop computer.

7. A method of attaching an object to a specially designed security slot of a portable device to inhibit theft of the portable device, comprising the steps of:

articulating, about a pin defining an articulation point, an attaching device to an unlocked position, said attaching device having a first leg and a second leg pivotally coupled to each other intermediate a first end and a second end of each leg wherein said legs rotate within a plane of rotation, said first ends including opposing flanges, said flanges extending in said plane of rotation and adapted to engage an inner surface of the portable device when said first end is inserted into the security slot and said attaching device is articulated into a locked position, wherein an aperture is formed in said second ends when said attaching device is in locked position such that an object passing through said aperture inhibits articulation to said unlocked position; thereafter inserting said first ends into the security slot of the portable device; and thereafter articulating said attaching device to said locked position to engage said flanges of said first end with said inner surface and to space apart said second ends, and thereafter coupling a cable through said spaced second ends and to a second object other than to the portable device to inhibit theft of the portable device.

8. The method of claim 7 wherein said aperture is formed by said second ends having an arcuate shape.

9. A locking mechanism, comprising:

a portable electronic device having a security slot, said slot having dimensions of approximately 7 mm by 3 mm;

a locking apparatus, comprising:

a first member and a second member, pivotally coupled to each other about an articulation point defined by a pin, each of said members having an engagement flange on a first end and handles on a second end, said first member and said second member relatively defining a first position and a second position, wherein said engagement flanges are insertable into the security slot when said members are rotated to said first position and wherein said engagement flanges extend beyond a perimeter of the security slot in a plane perpendicular to an axis of rotation defined by said pin when said members are rotated to said second position so that said members are retained within the security slot by said flanges; and a retainer, coupled to said handle of said first member and to said handle of said second member for maintaining said members in said second position.

10. A locking interface comprising:

a portable electronic device having a wall defining a security slot, said security slot having a predetermined shape and said shape further having at least one section wherein the section's length is greater than its width and wherein said security slot is approximately 7 mm in length and approximately 3 mm in width, and said wall including an inner surface;

a first leg and a second leg, pivotally coupled to rotate within a plane of rotation about an articulation point defined by a pin, each of said legs having opposing flanges extending within said plane of rotation on a first end and opposing handles on a second end, said first leg and said second leg having a second position and a first position, said opposing flanges of said first leg and said second leg adapted for concurrent insertion and removal from the slot of said portable electronic device when in said first position, and said opposing flanges of said first leg and said second leg adapted for engagement with said inner surface when in said second position; and a retainer, coupled to said opposing handle of said first leg and to said opposing handle of said second leg, adapted for retaining said first leg and said second leg in said second position.

11. A locking interface comprising:

a portable electronic device having a wall defining a security slot, said security slot having a predetermined shape and said shape further having at least one section wherein the section's length is greater than its width wherein said security slot is approximately 7 mm in length and approximately 3 mm in width, and said wall including an inner surface;

a first and a second leg, pivotally coupled to rotate within a plane of rotation about an articulation point defined by a pin, each of said legs having opposing flanges extending within said plane of rotation on a first end and opposing handles on a second end, said first leg and said second leg having a second position and a first position, said opposing flanges of said first leg and said second leg adapted for concurrent insertion and removal from the slot of said portable electronic device when in said first position, and said opposing flanges of said first leg and said second leg adapted for engagement with the inner surface when in said second position; and means, coupled to said opposing handle of said first leg and to said opposing handle of said second leg, adapted for retaining said first leg and said second leg in said second position.

12. A locking interface comprising:

a portable electronic device having a wall defining a security slot, said security slot having a predetermined shape and said shape further having at least one section wherein the section's length is greater than its width wherein said security slot is approximately 7 mm in length and approximately 3 mm in width, and said wall including an inner surface; and a first and a second leg, pivotally coupled to rotate within a plane of rotation about an articulation point defined by a pin, each of said legs having opposing flanges extending within said plane of rotation on a first end and opposing handles on a second end, said first leg and said second leg having a second position and a first position, said opposing flanges of said first leg and said second leg adapted for concurrent insertion and removal from the slot when in said first position, and said opposing flanges of said first leg and said second leg adapted for engagement with said inner surface when in said second position, said opposing handles of said first leg and said second leg defining an aperture, said aperture adapted for inhibiting said first leg and said second leg from moving from said second position to said first position only when an object extends through said aperture.

13. A system for inhibiting theft, comprising:

a portable electronic device having a wall defining a security slot, said security slot having a predetermined shape and said shape further having at least one section wherein the section's length is greater than its width, and said wall including an inner surface;

an attaching apparatus including:

a first leg and a second leg, pivotally coupled to rotate with a plane of rotation about an articulation point defined by a pin, said legs each having a flange at a first end, with said flange of said first leg oppositely directed in relation to said flange of said second leg and extending within said plane of rotation, said legs each having a second end with said articulation point intermediate said first end and said second end, said legs together defining an unlocked position and a locked position wherein said first ends of said legs are adapted to be inserted into said security slot and removed from said security slot when in said unlocked position, and retained in said security slot when in said locked position, said second ends defining a closed aperture when in said unlocked position, and said second ends widening apart by a predetermined space to define an widened aperture in said locked position, such that an object passing through said widened aperture when said legs are in said locked position inhibits articulation of said legs to said unlocked position; and a cable passing through said widened aperture for attaching to an object other than said portable electronic device.

14. A system for inhibiting theft, comprising:

a portable electronic device having a wall defining a security slot, said security slot having a predetermined shape and said shape further having at least one section wherein the section's length is greater than its width wherein said security slot is approximately 7 mm in length and approximately 3 mm in width, and said wall including an inner surface;

an attaching apparatus including:

a first leg and a second leg, pivotally coupled to rotate with a plane of rotation about an articulation point defined by a pin, said legs each having a flange at a first end, with said flange of said first leg oppositely directed in relation to said flange of said second leg and extending within said plane of rotation, said legs each having a second end with said articulation point intermediate said first end and said second end, said legs together defining an unlocked position and a locked position wherein said first ends of said legs are adapted to be inserted into said security slot and removed from said security slot when in said unlocked position, and retained in said security slot when in said locked position, said second ends defining a closed aperture when in said unlocked position, and said second ends widening apart by a predetermined space to define an widened aperture in said locked position, such that an object passing through said widened aperture when said legs are in said locked position inhibits articulation of said legs to said unlocked position; and a first object passing through said widened aperture for attaching to a second object other than said portable electronic device.

15. An attachment apparatus for inhibiting theft of a portable device, comprising:

means for pivotally engaging a specially designed security slot of a portable device, said security slot having a predetermined shape and said shape further having at least one section wherein the section's length is greater than its width and wherein said security slot is approximately 7 mm in length and 3 mm in width; and means, coupled to said engaging means, for securing said engaging means to an object other than said specially designed security slot.

16. A locking interface comprising:

a portable electronic device having a wall defining a security slot, said security slot having a predetermined shape and said shape further having at least one section wherein the section's length is greater than its width, and said wall including an inner surface;

a first leg and a second leg, pivotally coupled to rotate within a plane of rotation about an articulation point defined by a pin, each of said legs having opposing flanges extending within said plane of rotation on a first end and opposing handles on a second end, said first leg and said second leg having a second position and a first position, said opposing flanges of said first leg and said second leg adapted for concurrent insertion and removal from the slot of said portable electronic device when in said first position, and said opposing flanges of said first leg and said second leg adapted for engagement with said inner surface when in said second position; and a retainer, coupled to said opposing handle of said first leg and to said opposing handle of said second leg, adapted for retaining said first leg and said second leg in said second position;

wherein said opposing handles define an aperture and wherein said retainer is a cable passing through said aperture.

* * * * *